United States Patent [19]

Sparr

[11] 4,362,452

[45] Dec. 7, 1982

[54] PROCESS AND APPARATUS FOR LOADING AND EMPTYING A STORE FOR PRESS SUPPORTS

[75] Inventor: Werner Sparr, Pfungstadt, Fed. Rep. of Germany

[73] Assignee: Carl Schenck AG, Fed. Rep. of Germany

[21] Appl. No.: 204,606

[22] Filed: Nov. 6, 1980

[30] Foreign Application Priority Data

Mar. 3, 1980 [DE] Fed. Rep. of Germany ..... 3008090

[51] Int. Cl.[3] ..... B65H 1/04; B65H 1/06

[52] U.S. Cl. ..... 414/37; 271/3.1; 198/347; 198/472; 414/786

[58] Field of Search ..... 414/112, 124, 130, 37, 414/786; 198/347, 472, 473; 271/3.1

[56] References Cited

U.S. PATENT DOCUMENTS

| | | | |
|---|---|---|---|
| 1,672,522 | 6/1928 | Greer et al. | 198/472 |
| 1,732,228 | 10/1929 | Greer et al. | 198/472 |
| 3,753,559 | 8/1973 | Ries et al. | 271/3.1 |

*Primary Examiner*—Robert J. Spar
*Assistant Examiner*—Terry Flower
*Attorney, Agent, or Firm*—Connolly and Hutz

[57] ABSTRACT

Temporary storage for flexible underlayments or press supports being transported in the manufacture of chipboard is provided by dragging the underlayments over a storage pit into which their rear ends are allowed to drop. Protruding ends of head leaders by which the supports are dragged by longitudinally moving catches, are inserted in a rack having stacked ledges disposed on both sides of the path of travel of the press supports. The rack is indexed downwardly one step at a time as each head leader is inserted into the rack to stack the press supports one above the other in the pit. Press supports are retrieved from storage by raising the rack to realign the head leader with the path of travel of the transporting catches. The rack may be a rigid vertical stack of ledges, or it may constitute a paternoster-type elevator. The catches may include a disengageable mechanism or may be mounted or successive conveyors between which they transfer or drop the press supports in accordance with the vertical deployment of the rack.

15 Claims, 13 Drawing Figures

40
53
58
57
55
4
3
Conveyor Direction 58
59
Unlatch 58
60
latch 56
53
61
62

40
2
53
56
58
54
4B
4B
55
4

40
55
2
54
26
58
53

PROCESS AND APPARATUS FOR LOADING AND EMPTYING A STORE FOR PRESS SUPPORTS

BACKGROUND OF THE INVENTION

The present invention concerns a process and an apparatus for loading and unloading a store for press supports by means of conveyors in an installation for manufacturing, especially resin-bonded chipboards.

From West German Offenlegungsschrift No. 16 53 319 which concerns a process and apparatus for the manufacture and transport of chipboards consisting of one or more layers, a store (cf. FIG. 1) has become known, in which supports stripped of the chipboards are introduced into an intermediate store, from which they are reintroduced into the manufacturing process after a temporary storage.

From West German Pat. No. 22 36 937, an intermediate store for flexible press supports provided with head leaders in an installation for the manufacture of chipboards has become known, which store has a feed conveyor, a storage conveyor, and a discharge conveyor, with the storage conveyor, in the shape of a drum, being able to temporarily store the press supports to be stored during their downward delivery, and to transfer these supports as needed over the transfer conveyor. The capital investment for such an intermediate store is considerable, and difficulties also occur, especially at high throughput capacities, in connection with the positioned fixing of the supports. Furthermore, if there is no support to be stored temporarily, it is impossible to reintroduce the support directly into the manufacturing process by bypassing the store. Another difficulty in the known store lies in the fact that it is impossible to store rigid supports.

Based on this state of the art, it is the basic task of the present invention to improve an intermediate store of the type described in the introduction in such a way that while avoiding the difficulties involved in delivery in correct position, it will be possible to bypass the intermediate store in case of need. This task is accomplished according to the present invention in that the press support, being in constant, steady motion, can be deposited in one of the stations of the store, and after deposition, the store steps forward by one station. By keeping the press support ready in the storage zone for possible storage, it is surprisingly possible to either transport the press support further, passing through the store, i.e., to transport it directly in the manufacturing cycle, or store the press support without interrupting the transportation of further press supports into the manufacturing process, which can be advantageous especially in case of damage to one of the press supports, because it is thus possible to eliminate one press support without interrupting the operation of the manufacturing installation.

SUMMARY OF THE INVENTION

In one solution of the object of the present invention, the time for one loading or unloading of the store is shorter than the running time of the length of one storable press support having constant, steady velocity. This solution makes it possible to load a store with minimum dead time, because no additional time is needed in excess of the time inherently needed for the introduction of a support having a given length. Especially in manufacturing installations in which multilayer presses are used to consolidate pressed mats, it is advantageous also with respect to increasing the throughput for the transport of the press supports stripped of its board if there are no additional dead times in this transport section other than those inherently determined by the assembly unit.

The process according to the present invention is applicable to rigid press supports and also to flexible press supports because of its flat storage process. Moreover, this flat storage process can also be applied to chipboards which have a cement bond instead of a resin bond, especially because during the discharge of cement-bound chipboard a large number of empty supports occurs for a short time, and this accumulation of press supports is to be eliminated as fast as possible.

One device for carrying out the process, which on the basis of the state of the art, as described in the introduction, is provided with a feed conveyor with catches for press supports, with a movable storage conveyor, and with a subsequent transfer conveyor in an installation especially for the manufacture of resin-bound chipboard, is characterized by the fact that the empty belt of a single conveyor with catches transports press supports over support rails, which are interrupted in the zone of the storage device, and that there is at least one rack for accepting edge parts of the press supports, which rack is vertically movable at least one step at a time. The rack is disposed on the right and left of the conveyor, with the rack consisting of a number of ledges stacked one on top of another, with the spaces between them being open in the direction of transport, and that there is at least one depositing plate between and below the support rails ahead of the rack in the direction of transport. This arrangement is characterized by simplicity, small overall height, and by the fact that it is possible to introduce a press support that may have to be stored without interrupting the material flow being moved past it, or it can be transported through the store without unduly dragging on the press supports already deposited, in the case of rigid press supports. As was mentioned already, the rack, acting as a store, can serve as a separating and discharging point for press supports to be eliminated, when one of the vertical side walls about the rack can be swung out of the way according to the present invention.

One embodiment of the object of the present invention lies in the fact that at least one pusher is provided as auxiliary conveyor in the zone of the rack. This pusher is advantageous especially when rigid catches are used, because in this case it is possible to bring about the lift-off of the dragging head leaders of the press supports from the catches by acceleration of the pusher ahead of the constant steady velocity of the main conveyor, and the pusher is able to deliver the press supports being transported on the support rails to the storage rack. In the case of through-delivery, the pusher does not act as an auxiliary conveyor. The pusher is arranged before or after the storage rack in the transport direction, or to the left or to the right of the delivery section, depending on the press supports to be delivered. Thus, it is recommended to arrange pushers to the left and right of the rack store in the case of flexible press supports, and is recommended to arrange it behind the rack, above the support plane, in the case of rigid press supports. It is, however, possible to switch one mode of arrangement to the other at any time.

In another embodiment of the object of the present invention, it is possible to arrange at least one vertical guide wall opposite to the delivery direction at the rack in the case of delivery of flexible press supports, and to provide a depositing plate for the flexible press supports. This design makes it possible to deposit, when storing such supports, the head leader front edge tilted up at an angle to the horizontal, so that pick-up is very easy during the discharge of the head leader by one conveyor serving as a feed and discharge conveyor, namely, by its catches, or even another conveyor, serving as a discharge conveyor, can reliably reach with its catches behind the head leader standing tilted obliquely upward. The other vertical guide wall simplifies and improves the orienting process of the flexible supports.

In the design of the object of the present invention, it is proposed that the depositing plate have an elevation in the middle. As was mentioned already, maintaining the head leaders in oblique tilted position is achieved by such a design, and it is, moreover, guaranteed that a fed-through flexible support will not roll up the back part of already deposited flexible supports by dragging over it, which might in principle be possible because of the backward slanting. Thus, the stored supports are positively secured at this point against being accidentally entrained by fed-through supports sliding over them or against rolling up during the storage by supports being introduced.

In still another embodiment of the object of the present invention, it is proposed that the flexible support be carried in the zone of the head leader by one narrow conveyor to the right and one to the left, and that it can be fed into the rack by at least one other conveyor, running in the same direction as the first conveyor, and that another conveyor, reaching in front of the rack in the direction of delivery, can be brought into operative connection with the head leaders carried only by the narrow conveyors for the further conveying of the flexible supports. This arrangement permits the introduction of the flexible supports into the storage rack and at the same time also permits feeding through the storage rack by cooperating with a new discharge conveyor, which can be brought into operative connection with the flexible support even before the storage rack.

Another possibility for designing the storage rack lies in that fact that the rack consists of at least one paternoster-like elevator for each delivery side, whose guide wheel axes are arranged parallel to the delivery direction outside the conveyor contour, and that the conveying means running over the guide wheels carry angles, one leg of which is parallel to the guide wheel axis at the conveying means, and that during introduction, the stored supports are moved downward by one level. As opposed to the other design of the vertical rack of depositing plates, which reach beyond the conveyor to the storage place during indexing and which must have spindles or toothed racks as operating means, the design of the paternoster-like elevator represents a rack possibility in which there are no drive elements beyond the delivery level of the store during the storage process.

In yet another embodiment of the object of the present invention, it is proposed that the catches for the supports can be swung out by means of a deflecting cam in the area of the transfer zone. This design of the swing-out of the catches in the transfer zone into the rack makes it possible to do without auxiliary conveyors, such as pushers, which overrides rigid catches, and to transfer the fixed leaders of the flexible supports to the next conveyor in the zone of the transfer of a flexible support held between the two conveyors without carrying out any storage operation in the rack, without risk of damage to the catches due to possible differences in the velocities of the conveyors.

BRIEF DESCRIPTION OF THE DRAWINGS

Novel features and advantages of the present invention will become apparent to one skilled in the art from a reading of the following detailed description in conjunction with the accompanying drawings wherein similar reference characters refer to similar parts and in which:

FIG. 1 is a diagrammatic side-elevational view of a flexible press support store having a vertically stacked storage rack which is one embodiment of this invention;

DESCRIPTION OF THE PREFERRED EMBODIMENTS

Figures 1A, 1B:
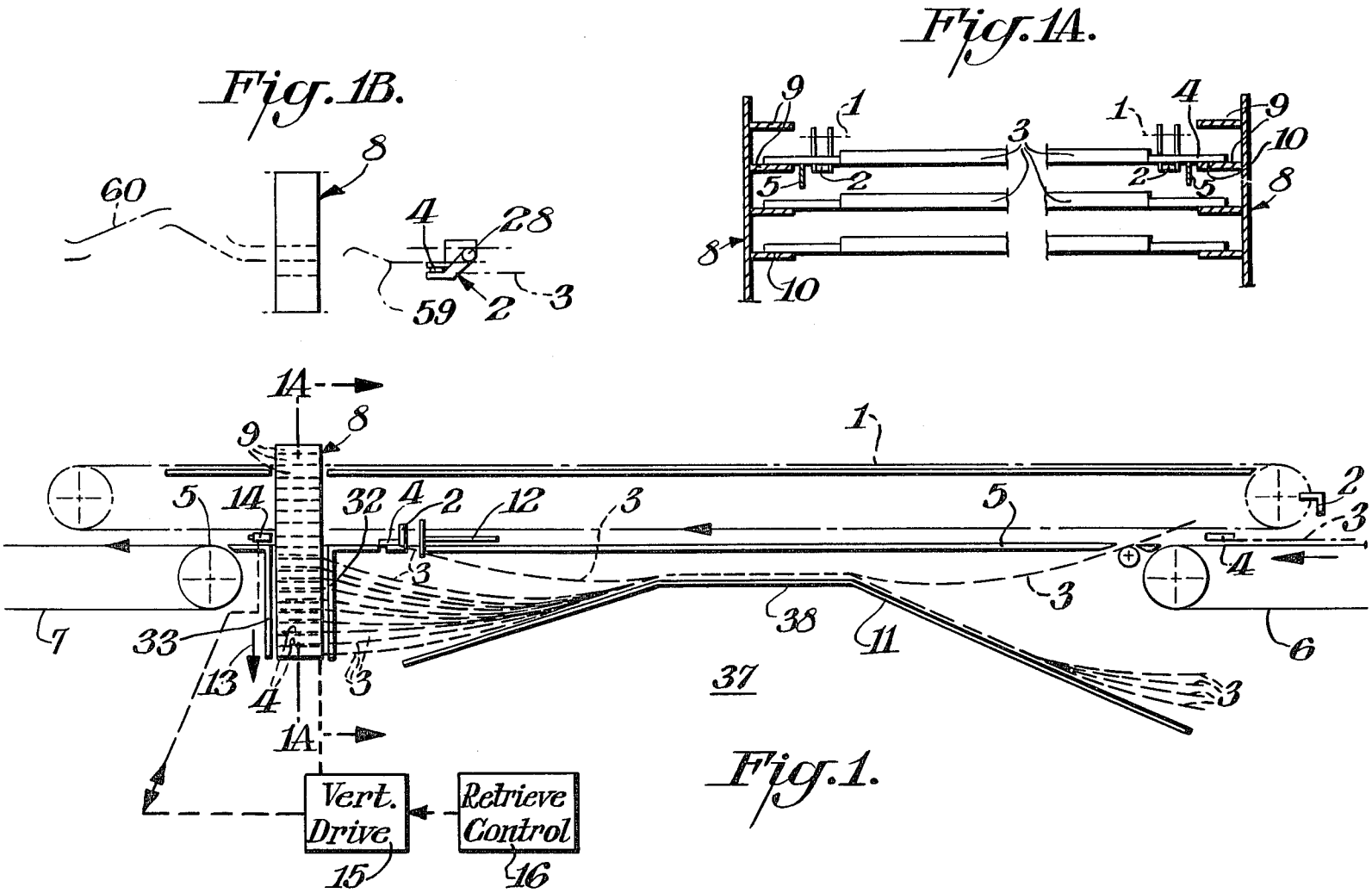
FIG. 1A is a cross-sectional view in elevation taken through FIG. 1 along line 1A—1A.
FIG. 1B is a schematic diagram showing positions of catch-operating cams of FIGS. 4, 4A, 5, 6 and 6A relative to FIG. 1.

According to FIGS. 1 and 1A, a conveyor 1 with catches 2 drags a flexible press support 3 by the ends of head leader 4 longitudinally over support rails 5. In the example described in FIG. 1, the flexible press supports 3 are taken up by a belt type conveyor 6, which is installed behind a press ejection station (not shown). The conveyor 1 picks up flexible press supports 3, by means of the catches 2 and drags them by leaders 4 via support rails 5 to a forward conveyor 7. In the zone between belt type conveyor 6 and forward conveyor 7, there is a rack 8, whose cross section is shown in FIG. 1A, and in which flexible press supports 3 can be temporarily stored by insertion of leaders 4 for later use. Rack 8 includes lateral opposed stacks of open sided compartments 9 with each ledge of compartment 9 serving as support 10 for leaders 4. One side of rack 8 is installed to the right and one to the left of conveyor 1. However, it is possible, especially in the case of rigid press supports, to install a plurality of rack pairs 8 in the zone between belt type conveyor 6 and forward conveyor 7 in order to make it possible to deposit the edges of such rigid supports in racks 8.

In FIG. 1 is shown plate 11 installed in pit 37 for receiving flexible underlayments 3, which are dropped down upon plate 11. The mid-portion 38 of plate 11 is elevated so that the front ends of underlayments 3 can be inserted by head leaders 4 with the remainder of underlayments 3 in a somewhat bowed disposition with leaders 4 tilted obliquely in position to be engaged by catches 2. FIG. 1 shows leaders 4 in position for engagement by catches 2 when leaders 4 are raised by upward movement of rack 8 to the level of movement of catches 2. Leaders 4 are accordingly obliquely disposed rear end up in compartments 9 by the disposition of the flexible underlayments 3 on the elevated central portion 38 of plate 11. This facilitates that further transportation of flexible underlayments 3 by facilitating engagement of catches 2 under leaders 4.

Elevated midportion 38 also deflects stored underlayments 3 so that they will not have their rear portions rolled up by a following stored underlayment 3, which drags over them. It also prevents a stored underlayment from being accidentally entrained by following stored underlayments which drags over it.

Figures 4, 4A, 4B, 5, 6, 6A:
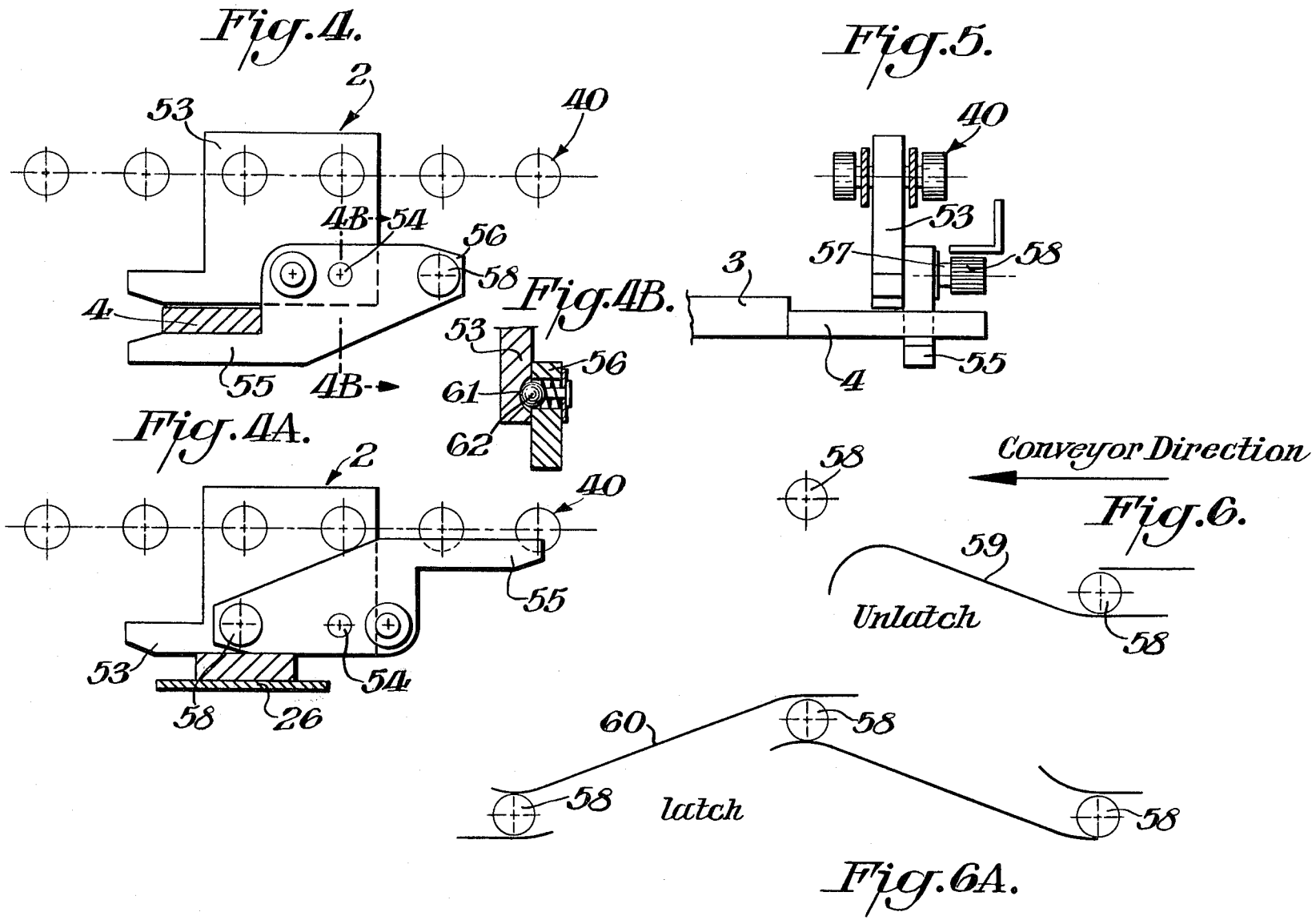
FIG. 4 is a side elevational view of a portion of a chain conveyor and catch assembly in dragging engagement with the flexible press supports.
FIG. 4A is a side-elevational view of the assembly shown in FIG. 4 illustrating the catch opened and transferring the flexible press support at the rack station of FIG. 2.
FIG. 4B is a cross-sectional view taken through FIG. 4 along the line 4B—4B of the ball and detent engaging assembly for the catch shown in FIGS. 4 and 4A.
FIG. 5 is an end elevational view of the catch assembly shown in FIG. 4.
FIG. 6 is a profile of the cam located ahead of the rack station for unlatching the catch from the drag position shown in FIG. 4 to the transfer position shown in FIG. 4A.
FIG. 6A is a profile of the cam located after the rack station to return the catch to the drag position of FIG. 4.

It is also shown in FIG. 1 that support rails 5 are interrupted only in the zone ahead of rack 8, so that as is shown in more detail in FIG. 4, when catches 2 are swung out, flexible support 3 with its leader 4 drops directly onto ledges 10, or as is shown in FIG. 1, pusher 12, which is preferably installed at the level of support rails 5, reaches behind the leaders 4 and, during a short-term stoppage of conveyor 1, it pushes the flexible press support 3 with its leader 4 over an opposed pair of support ledges 10 at previous uniform speed of conveyor 1. After this pushing process, rack 8 moves downwardly in the direction of arrow 13 by one depositing ledge 10, so that a free level is available for a new storage process. During the feed-through of a flexible support 3, leader 4 serves as a bridge between support rails 5.

FIG. 1 schematically shows microswitch 14 positioned in line with the path of movement of catches 2 for actuating vertical drive 15 to drop rack 8 in the distance of one compartment 9 after leader 4 has been released from the catch and inserted into a compartment 9 of rack 8. Retrieve control 16 permits manual actuation of vertical drive 15 to move rack 8 upwardly the distance of one compartment 9 at a time to reinsert leader 4 into the path of travel of catch conveyor 1 for retrieving one of press supports 3 and returning it to the line of transport of press supports 3 through conveyors 1 and 7.

After pushing in leader 4 of a flexible support 3, pusher 12 can be brought out of the path of movement of the next flexible press support 3, e.g. by swinging it out, so that it is in its position as an auxiliary conveyor only when a storing process for a flexible support 3 is actually being performed.

Figure 2:
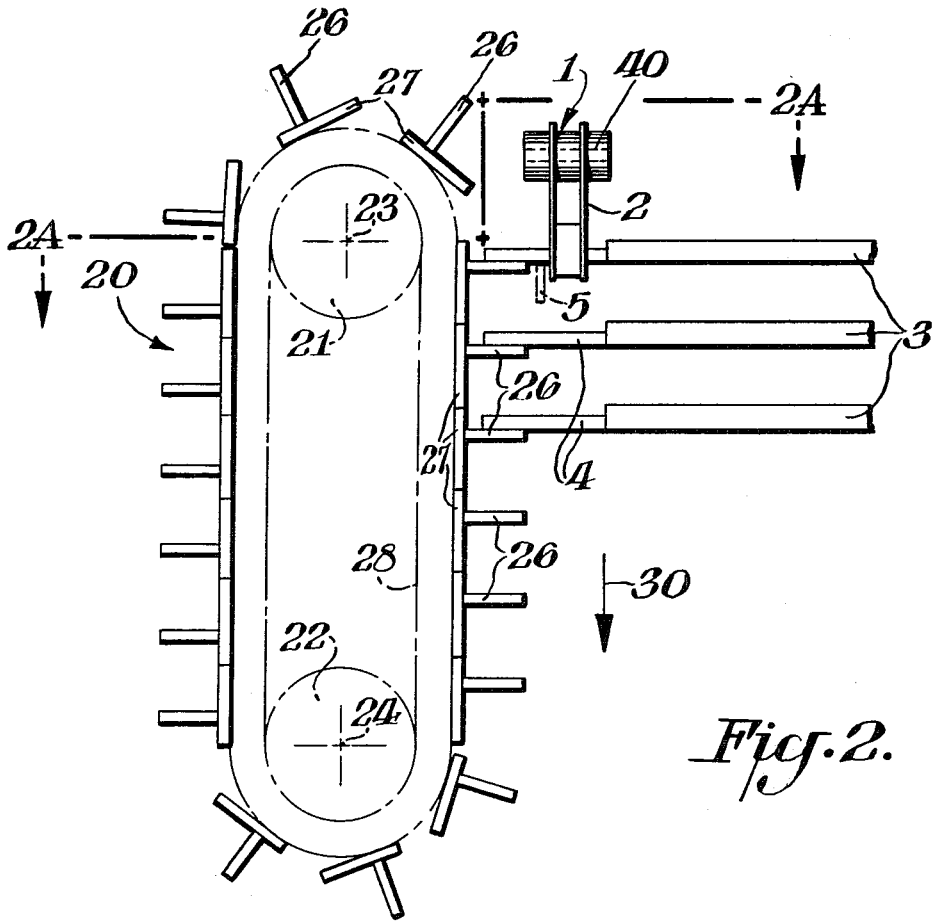
FIG. 2 is a diagrammatic side-elevational view of a storage rack with a paternoster-like elevator which is another embodiment of this invention.

FIG. 2 shows a paternoster-like elevator 20, which has guide wheels 21, 22, whose axes 23, 24 extend parallel to the direction of transport, and on which angle legs 26 are mounted as ledge supports for leaders 4 of flexible press supports 3. One vertical leg 27 of angle leg 26 is connected with a drive element of the elevator, e.g., with a chain 28. Here, too, after introduction of a flexible press support 3 with leaders 4, the elevator 20 is tripped downward by one level in the direction of the arrow 30, so that a new angle leg 26 serves subsequently as a support ledge for a leader bridge between support rails 5.

Figure 2A:
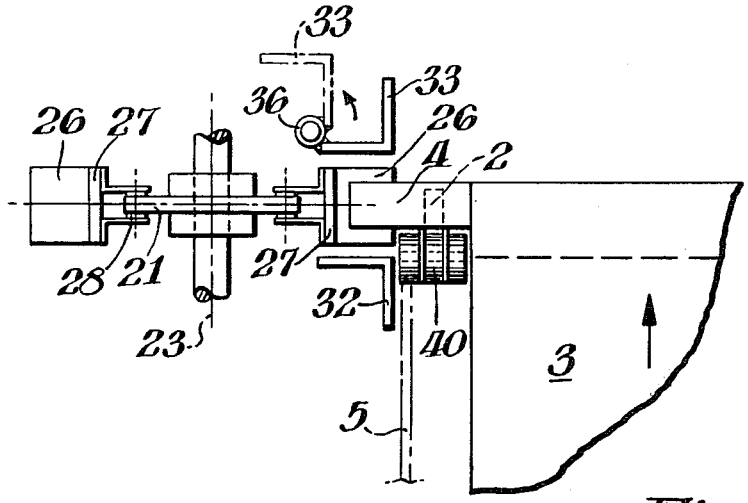
FIG. 2A is a cross-sectional plan view taken through FIG. 2 along the line 2A—2A showing ledge supports for the flexible press support head leader lateral extension.

In the top view of FIG. 2A of FIG. 2, guide walls 32, 33 are provided before and after the angle legs 26, with the guide wall 32 being used for positioning in the case of the transport of flexible press supports 3, while the similar vertical guide wall 33 permits discharge of a support 3 via a swivel 36 shown here schematically by swinging around joint 36.

FIG. 1B shows the relative vertical positions of cams 59 and 60 to the path of travel of catches 2 and edge supports 4, and also the longitudinal positions of corresponding portions of FIG. 1 with which it is longitudinally aligned.

In FIG. 2 conveyor 1 is in the form of a chain conveyor 40 with a flexible press support 3 with its leader 4 being pushed into the paternoster-like elevator by means of the catch 2, which is described in more detail in FIG. 4.

Figure 3A:
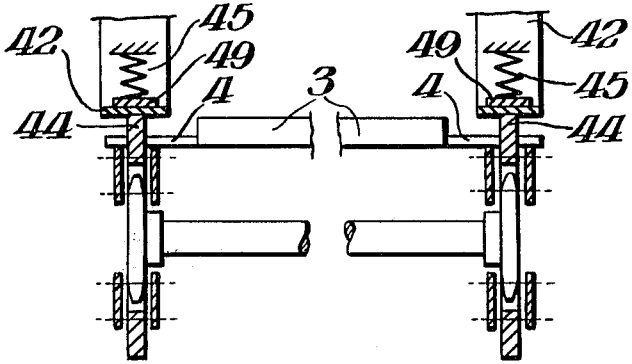
FIG. 3A is a cross-sectional view in elevation taken through FIG. 3 along the line 3A—3A illustrating carrying conveyors which are installed to the left and right of the path of the flexible support sheets.
Figure 3:
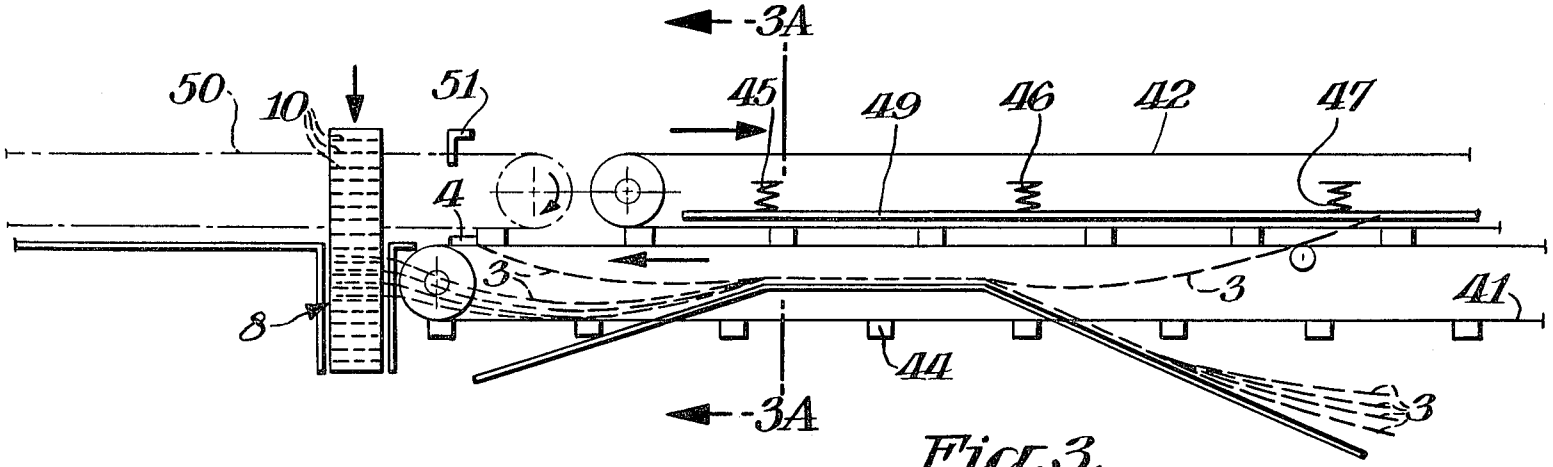
FIG. 3 is a diagrammatic side-elevational view showing a transfer point between the feed conveyor without intermediate storage for flexible press supports which is still another embodiment of this invention.

FIG. 3 shows, in connection with a rack 8 a carrying conveyor 41 and another conveyor 42, which carry along between them a flexible press support 3 provided with a leader 4. Carrying conveyor 41, which is installed as narrow conveyors to the left and right of flexible support 3, is equipped for this purpose with carrying blocks 44, before which the leader 4 of flexible supports 3 can lie. In the zone of the lower side of the contact-pressure conveyor 42 above its conveyor belt, there is a plate 49 supported by springs 45, 46, 47, which plate prevents disengagement of the leaders 4 from carrying blocks from occurring. Before rack 8, flexible support 3 being carried on carrying conveyor 41, is transferred to another conveyor 50, unless the support is to be introduced into rack 8. For transfer to the next conveyor 40, a catch 51 catches behind the leader 4 and transports it. e.g. at increased speed, for coating with particles to be pressed into boards, which particles are provided with resin or cement of a binder.

A catch 2 is described in more detail in FIGS. 4, 4A and 5 in the transfer zone. For example, in the transfer zone shown in FIG. 2, catch 2 can be swung up at the paternoster-like elevator. Catch 2 consists of upper support plate 53 mounted on a drag chain 40 and an attached lower pivotable plate 55 connected with it via a pivot 54, with the lower plate 55 carrying a guide bar 57 on a cantilever, which bar 57 is connected with a guide roller 58, which brings about the opening of the lower plate by travel along a cam 59, so that leader 4 can be deposited directly on a ledge 26, within rack 8, namely, without stoppage of the conveyor as shown in FIG. 4A. Another cam 60 causes the latching of the lower plate 55 of catch 2. Cams 59, 60 are installed in the zone of rack 8. Engagement of arresting detent 61 by means of a spring-loaded ball 62 is performed between top plate 53 and lower plate 55 of catch 2, as shown in FIG. 4, FIGS. 6 and 6A.

I claim:

1. A process for loading and emptying a temporary store for press supports installed in a conveyor line, comprising the steps of catching and dragging the press supports by their front ends over a storage pit into which the trailing portion of the press support is dropped, the front ends of the press supports being inserted in a storage rack disposed on both sides of the conveyor line, the vertical position of the storage rack being controlled to determine whether the press support is immediately transferred forward along the conveyor line or dropped below its path of movement to temporarily store the press support in the pit, stored press supports being removed from storage by raising the rack to catch the front end of the press support and resume its transport along the conveyor line.

2. A process as set forth in claim 1, wherein the front ends of the press supports are inserted into the racks at an increased rate of speed over that of the conveyor line.

3. A process as set forth in claim 1, wherein the front ends of the press supports are inserted into the racks and removed therefrom at about the same rate of movement as the conveyor line.

4. An apparatus for the temporary storage of press supports moved along a conveyor line in a manufacturing process comprising a storage pit disposed below a portion of the conveyor line, edge support means connected to the front ends of the press supports, catch means on the portion of the conveyor line disposed above the storage pit for dragging the press supports by their front ends over the storage pit with rear ends dragging within the storage pit, a storage rack for receiving the edge supports disposed on both sides of the conveyor line past the storage pit in the direction of movement of the press supports, the storage racks having stacks of ledges for receiving the edge supports of press supports one on each ledge, vertical indexing means connected to the rack for controlling the vertical position of each of the ledges to provide storage of the press supports within the pit when the ledges are disposed below the path of movement of the catch means and retrieval from the pit and transport along the conveyor line when disposed in alignment with the path of movement of the catch means.

5. An apparatus as set forth in claim 4, wherein auxiliary pusher means are disposed ahead of the rack in the path of movement of the catch means, and the pusher means operating at a rate of speed greater than that of the conveyor line whereby the edge supports are inserted into the rack, and disengaged from the catch means.

6. An apparatus as set forth in any one of claims 4 or 5, wherein a depositing plate for receiving the press supports is disposed in the pit.

7. An apparatus as set forth in claim 4, wherein the depositing plate has a central elevation to facilitate the transport of press supports through the pit.

8. An apparatus as set forth in claim 4, wherein a vertical stop wall is provided past the rack in the direction of movement of the conveyor line for arresting the inserted edge supports in the rack, and removing means is connected to the stop wall for moving it out of the path of movement of an edge support while it is being retrieved from the pit and transported in the conveyor line.

9. An apparatus as set forth in claim 4, wherein the press supports are flexible, a leader being connected to the front of each press support to provide the edge supports, and a catch conveyor being disposed on each side of the conveyor line disposed over the pit for dragging the press supports over the pit.

10. An apparatus as set forth in claim 9, wherein guide rails are provided under the path of travel of press supports, and the guide rails terminating ahead of the pit in the direction of transport of the press supports.

11. An apparatus as set forth in claim 9, wherein a further conveyor is disposed past the rack in the direction of transport of the press supports on the conveyor line whereby further transport of supports retrieved from the pit is accomplished.

12. An apparatus as set forth in claim 4, wherein the rack comprises a rigidly connected stack of ledges, and vertical indexing means is connected to the stack for moving it downwardly to temporarily store a press support and upwardly into the level of the catch means for retrieving a press support from storage pit and inserting it into the conveyor line.

13. An apparatus as set forth in claim 4, wherein the rack comprises a paternoster-type vertical conveyor including guide wheels which are rotated to accomplished vertical movement of the rack.

14. An apparatus as set forth in claim 4, wherein the catches include release means for disengaging the catches from the press supports, and the release means includes cam means is disposed on the sides of the conveyor line in the zone of the rack for permitting the edge supports to be inserted into the rack.

15. An apparatus as set forth in claim 4, wherein the catch means comprises longitudinally moving blocks attached to a belt conveyor and sandwiched under a second belt conveyor for moving the edge supports over the pit, and a further conveyor including further catches overlapping the path of movement of the blocks for further transporting the edge supports and press supports.

* * * * *